United States Patent [19]

McMahan et al.

[11] 4,319,633

[45] Mar. 16, 1982

[54] DRILL PIPE TESTER AND SAFETY VALVE

[75] Inventors: Michael E. McMahan, Duncan; Gerald D. Jackson, Marlow; Burchus Q. Barrington, Duncan, all of Okla.

[73] Assignee: Halliburton Services, Duncan, Okla.

[21] Appl. No.: 136,831

[22] Filed: Apr. 3, 1980

[51] Int. Cl.[3] ..... E21B 34/08

[52] U.S. Cl. ..... 166/250; 166/332; 166/321; 251/77

[58] Field of Search ..... 166/332, 334, 250, 321, 166/324, 323; 251/77, 89, 352; 137/494

[56] References Cited

U.S. PATENT DOCUMENTS

| | | | |
|---|---|---|---|
| 3,347,318 | 10/1967 | Barrington | 166/321 |
| 3,509,913 | 5/1970 | Lewis | 166/321 |
| 3,667,505 | 6/1972 | Radig | 251/77 |
| 4,042,033 | 8/1977 | Holland et al. | 166/310 |
| 4,197,879 | 4/1980 | Young | 166/324 |
| 4,212,355 | 7/1980 | Reardon | 166/336 |
| 4,230,185 | 10/1980 | Fredd | 166/332 |

*Primary Examiner*—William F. Pate, III

*Attorney, Agent, or Firm*—John H. Tregoning; James R. Duzan; Lucian Wayne Beavers

[57] ABSTRACT

A drill pipe tester valve includes a spherical valve member supported from an upward facing surface of a housing so that downward forces exerted on the valve member in its closed position, due to fluid pressure in a string of pipe above the valve member, are transmitted substantially entirely to said housing. A latching device is provided for latching the spherical valve member in its closed position as the string of pipe and tester valve are lowered into a well and for subsequently releasing the spherical valve member and allowing it to move to its open position when the string of pipe and tester valve are finally positioned within the well.

25 Claims, 7 Drawing Figures

DRILL PIPE TESTER AND SAFETY VALVE

The following invention relates generally to drill pipe tester valves, and more particularly, but not by way of limitation, to drill pipe tester valves designed to be used above a formation tester valve in a well test string.

During the course of drilling an oil well, one operation which is often performed is to lower a testing string into the well to test the production capabilities of the hydrocarbon producing underground formations intersected by the well. This testing is accomplished by lowering a string of pipe, commonly referred to as drill pipe, into the well with a formation tester valve attached to the lower end of the string of pipe and oriented in a closed position, and with a packer attached below the formation tester valve. This string of pipe with the attached testing equipment is generally referred to as a well test string.

Once the test string is lowered to the desired final position, the packer means is set to seal off the annulus between the test string and a well casing, and the formation tester valve is opened to allow the underground formation to produce through the test string.

During the lowering of the test string into the well, it is desirable to be able to pressure test the string of drill pipe periodically so as to determine whether there is any leakage at the joints between successive stands of drill pipe.

To accomplish this drill pipe pressure testing, the string of drill pipe is filled with a fluid and the lowering of the pipe is periodically stopped. When the lowering of the pipe is stopped, the fluid in the string of drill pipe is pressurized to determine whether there are any leaks in the drill pipe above the formation tester valve.

With the apparatus and methods generally used in the prior art for testing the drill pipe as it is lowered into the well, the fluid in the string of pipe is generally contained within the drill pipe only by the closure of the formation tester valve. In other words, the pressure exerted on the fluid in the drill pipe is also exerted against the closed formation tester valve.

This prior art arrangement has often been utilized with a formation tester valve similar to that shown in U.S. Pat. No. 3,856,085 to Holden, et al. assigned to the assignee of the present invention. The Holden, et al. formation tester valve has a spherical valve member contained between upper and lower valve member seats.

The Holden, et al. formation tester valve is shown only schematically in U.S. Pat. No. 3,856,085, and the details of the mounting of the spherical valve member within the housing of the valve are not thereshown. The actual formation tester valve constructed according to the principles of Holden, et al. U.S. Pat. No. 3,856,085 has the upper valve seat for the spherical valve member suspended from an inner mandrel which is hung off an annular shoulder of the outer valve housing, in a manner similar to that shown in U.S. Pat. No. Re. 29,471 to Giroux, and assigned to the assignee of the present invention. The lower valve seat is connected to the upper valve seat by a plurality of C-clamps spanning around the spherical valve member. The lower valve seat member of the Holden, et al. formation tester valve does not, therefore, engage any supporting portions of the valve housing.

The spherical valve member of the Holden, et al. formation tester valve is held in place within the housing so as to prevent axial movement of the spherical valve member relative to the housing, and is engaged by eccentric lugs mounted on a sliding member which does move axially relative to the housing so that upon axial movement of the lugs relative to the housing, the spherical valve member is rotated relative to the housing to open and close the valve.

When pressure testing drill pipe located above a formation tester valve like that of Holden, et al., experience has shown that excessive pressure exerted upon the top surface of the spherical valve member of the Holden, et al. apparatus, causes the spherical valve member to exert a downward force on the eccentric lugs thereby shearing the eccentric lugs off their carrying member. This severely limits the maximum pressure which may be exerted upon the fluid within the drill pipe to pressure test the same, and it is particularly a significant problem in very deep wells where the mere hydrostatic pressure of the fluid within the drill pipe is relatively high. It has been determined that the maximum differential pressure which can safely be carried by the Holden, et al. valve is about 5000 psi.

Another prior art valve having a spherical valve member which does not move axially relative to its housing is the subsea test tree valve shown in U.S. Pat. No. 4,116,272 to Barrington.

Other prior art valves having a spherical valve member which does move axially relative to the housing are shown in U.S. Pat. No. 4,064,937 to Barrington; U.S. Pat. No. 3,568,715 to Taylor, Jr.; U.S. Pat. No. Re. 27,464 to Taylor, Jr.; U.S. Pat. No. 4,009,753 to McGill, et al.; and U.S. Pat. No. 3,967,647 to Young.

The present invention provides a drill pipe tester valve which is run in the well test string directly above a formation tester valve such as that of Holden, et al. U.S. Pat. No. 3,856,085. The drill pipe tester valve of the present invention overcomes the difficulties encountered due to pressure testing directly against the formation tester valve. The drill pipe tester valve has a lower valve seat which is supportably engaged by the valve housing, so as to prevent downward forces from being exerted upon the eccentric actuating lugs thereof when the fluid in the drill pipe is pressurized, thereby preventing the shearing of those lugs on the drill pipe tester valve. The drill pipe tester valve of the present invention can withstand differential pressures up to 10,000 psi.

Additionally, the drill pipe tester valve of the present invention provides an automatic fill-up feature which automatically allows the drill pipe located above the drill pipe tester valve to fill with well fluid as the test string is lowered into the well.

The drill pipe tester valve of the present invention has a housing having a first end adapted to be connected to the string of drill pipe, which housing has a flow passage therethrough. A spherical valve member is disposed in the flow passage of the housing. Lug means are attached to the housing for engaging the spherical valve member and rotating the spherical valve member between open and closed positions wherein the flow passage of the housing is open and closed, respectively, as the spherical valve member is moved axially relative to the housing and the lug means.

Moving means are provided for moving the spherical valve member axially relative to the housing between its said open and closed positions, which moving means includes a lower valve member seat means having a downward facing surface supportably engaged by an upward facing surface of the housing when the spherical valve member is in its said closed position. This permits downward forces exerted upon the spherical valve member in its said closed position due to fluid pressure in the string of drill pipe above the spherical valve member, to be transmitted substantially entirely to the housing through the engagement of the downward facing surface of the lower valve seat means and the upward facing surface of the housing.

A latch means is also provided for latching the spherical valve member in its said closed position as said string of pipe and drill pipe tester valve are lowered into the well. The latch means releases the spherical valve member and allows it to move to its open position during the formation testing procedures. After the formation testing procedures are completed, or at any other time when the weight of the well test string is picked up, the latch means provides a means for moving the spherical valve member back to its closed position thereby providing a safety valve feature in addition to the drill pipe testing feature of the drill pipe tester valve of the present invention.

Numerous features and advantages of the present invention will be readily apparent to those skilled in the art upon a reading of the following disclosure when taken in conjunction with the accompanying drawings.

It is appropriate at this point to provide a description of the environment in which the present invention is used. During the course of drilling an oil well, the borehole is filled with a fluid known as drilling fluid or drilling mud. One of the purposes of this drilling fluid is to contain in intersected formations any formation fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program.

Sometimes, lower pressure is maintained in the interior of the testing string as it is lowered into the borehole. This is usually done by keeping a formation tester valve in the closed position near the lower end of the testing string. When the testing depth is reached, a packer is set to seal the borehole thus closing in the formation from the hydrostatic pressure of the drilling fluid in the well annulus. The formation tester valve at the lower end of the testing string is then opened and the formation fluid, free from the restraining pressure of the drilling fluid, can flow into the interior of the testing string.

At other times the conditions are such that is desirable to fill the testing string above the formation tester valve with liquid as the testing string is lowered into the well. This may be for the purpose of equalizing the hydrostatic pressure head across the walls of the test string to prevent inward collapse of the pipe and/or may be for the purpose of permitting pressure testing of the test string as it is lowered into the well.

The well testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the well testing program, a circulation valve in the test string is opened, formation fluid in the testing string is circulated out, the packer is released, and the testing string is withdrawn.

Figure 1:
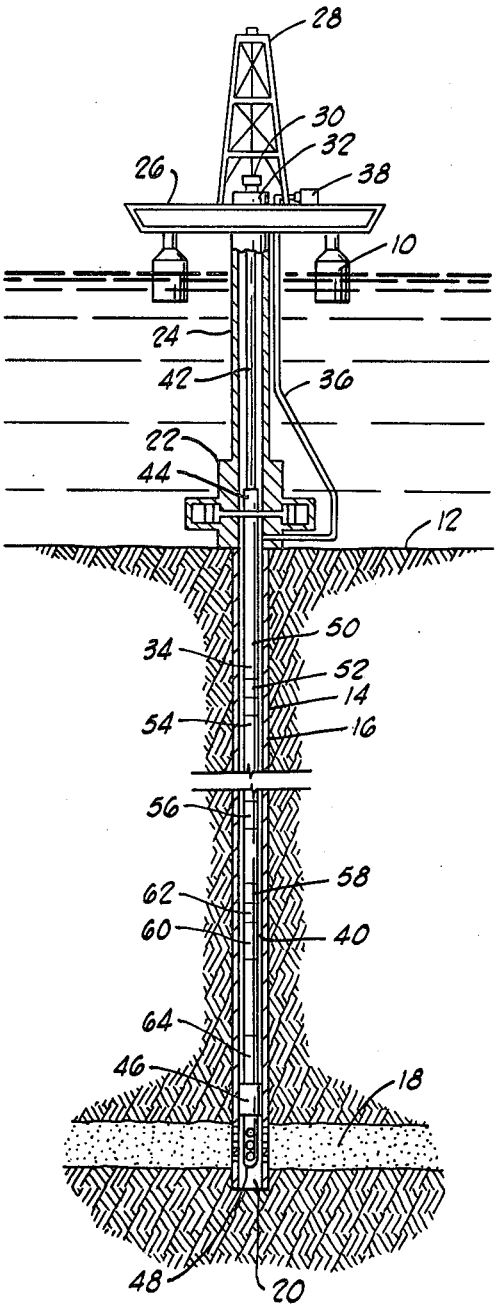
FIG. 1 shows a schematic view of a well test string in place within an offshore well.

A typical arrangement for conducting a drill stem test offshore is shown in FIG. 1. Such an arrangement would include a floating work station 10 stationed over a submerged work site 12. The well comprises a well bore 14 typically lined with a casing string 16 extending from the work site 12 to a submerged formation 18. The casing string 16 includes a plurality of perforations at its lower end which provide communication between the formation 18 and the interior of the well bore 20.

At the submerged well site 12 is located the well head installation 22 which includes blowout preventor mechanisms. A marine conductor 24 extends from the well head installation to the floating work station 10. The floating work station 10 includes a work deck 26 which supports a derrick 28. The derrick 28 supports a hoisting means 30. A well head closure 32 is provided at the upper end of marine conductor 24. The well head closure 32 allows for lowering into the marine conductor and into the well bore 14 a formation testing string 34 which is raised and lowered in the well by hoisting means 30.

A supply conduit 36 is provided which extends from a hydraulic pump 38 on the deck 26 of the floating station 10 and extends to the well head installation 22 at a point below the blowout preventors to allow the pressurizing of the well annulus 40 surrounding the test string 34.

The testing string 34 includes an upper conduit string portion 42 extending from the work site 12 to the well head installation 22. A hydraulically operated conduit string test tree 44 is located at the end of the upper conduit string 42 and is landed in the well head installation 22 to thus support to the lower portion of the formation testing string. The lower portion of the formation testing string extends from the test tree 44 to the formation 18. A packer mechanism 46 isolates the formation 18 from fluids in the well annulus 40. A perforated tail piece 48 is provided at the lower end of the testing string 34 to allow fluid communication between the formation 18 and the interior of the tubular formation testing string 34.

The lower portion of the formation testing string 34 further includes intermediate conduit portion 50 and torque transmitting pressure and volume balanced slip joint means 52. An intermediate conduit portion 54 is provided for imparting packer setting weight to the packer mechanism 46 at the lower end of the string.

It is many times desirable to place near the lower end of the testing string a conventional circulation valve 56 which may be opened by rotation or reciprocation of the testing string or a combination of both or by the dropping of a weighted bar in the interior of the testing string 10. Below circulating valve 56 there may be located a combination sampler valve section and reverse circulation valve 58, such as that shown in U.S. Pat. No.

4,064,937 to Barrington and assigned to the assignee of the present invention.

Also near the lower end of the formation testing string 34 is located formation tester valve 60 which is preferably a tester valve of the annulus pressure operated type similar to that disclosed in U.S. Pat. No. 3,856,085 to Holden et al. Immediately above the formation tester valve 60 is located the drill pipe tester valve 62 of the present invention.

A pressure recording device 64 is located below the formation tester value 60. The pressure recording device 64 is preferably one which provides a full opening passageway through the center of the pressure recorder to provide a full opening passageway through the entire length of the formation testing string.

It may be desirable to add additional formation testing apparatus in the testing string 34. For instance, where it is feared that the testing string 34 may become stuck in the borehole 14 it is desirable to add a jar mechanism between the pressure recorder 64 and the packer assembly 46. The jar mechanism is used to impart blows to the testing string to assist in jarring a stuck testing string loose from the borehole in the event that the testing string should become stuck. Additionally, it may be desirable to add a safety joint between the jar and the packer mechanism 46. Such a safety joint would allow for the testing string 34 to be disconnected from the packer assembly 46 in the event that the jarring mechanism was unable to free a stuck formation testing string.

The location of the pressure recording device may be varied as desired. For instance, the pressure recorder may be located below the perforated tail piece 48 in a suitable pressure recorder anchor shoe running case. In addition, a second pressure recorder may be run immediately above the formation tester valve 60 to provide further data to assist in evaluating the well.

Referring now the FIGS. 2A–2E, a half-section elevation view is thereshown of the drill pipe tester valve 62 of the present invention.

The drill pipe tester valve 62 includes a housing 66 including an upper adapter 68, a first cylindrical valve casing portion 70, a middle adapter portion 72, and a second valve casing portion 74.

The upper adapter 68 and first cylindrical valve casing portion 70 may generally be referred to as an upper housing portion 76, and the middle adapter portion 72 and second valve casing 74 may collectively be referred to as a lower housing portion 78.

An upper end 80 of lower housing portion 78 is received within a lower end 82 of upper housing portion 76, and attached thereto at threaded connection 84.

Housing 66 has an upper end 86 adapted to be connected to a string of pipe of formation testing string 34 (See FIG. 1) by means of an internally threaded connection 88. In this manner the entire weight of the portions of the test string 34 located below connection 88 is carried by the housing 66. Housing 66 has a flow passage 90 disposed axially therethrough.

Figure 2A:
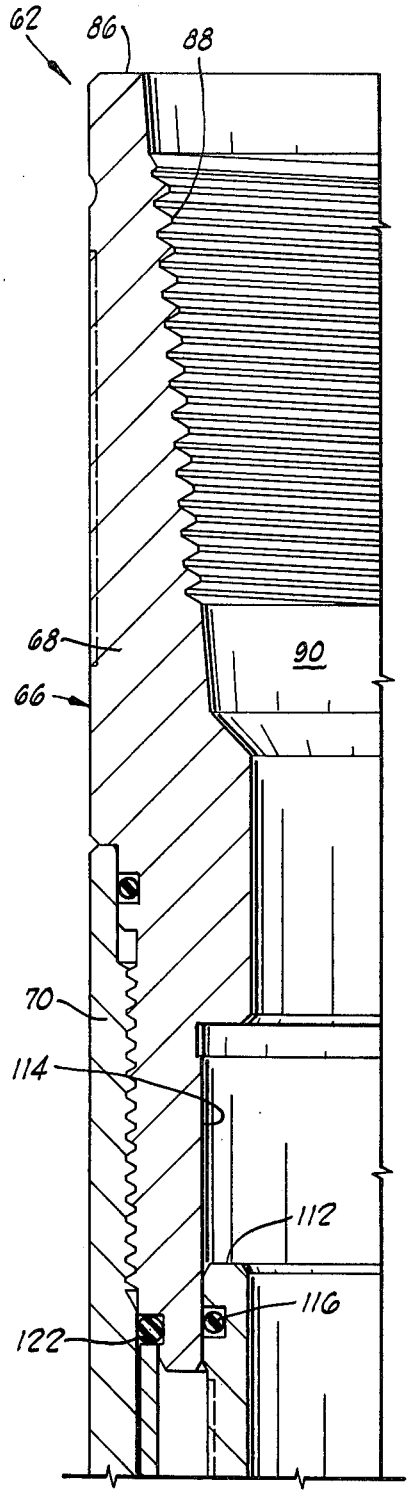
FIGS. 2A–2E show a half-section elevation view of the drill pipe tester valve of the present invention.
Figure 2B:
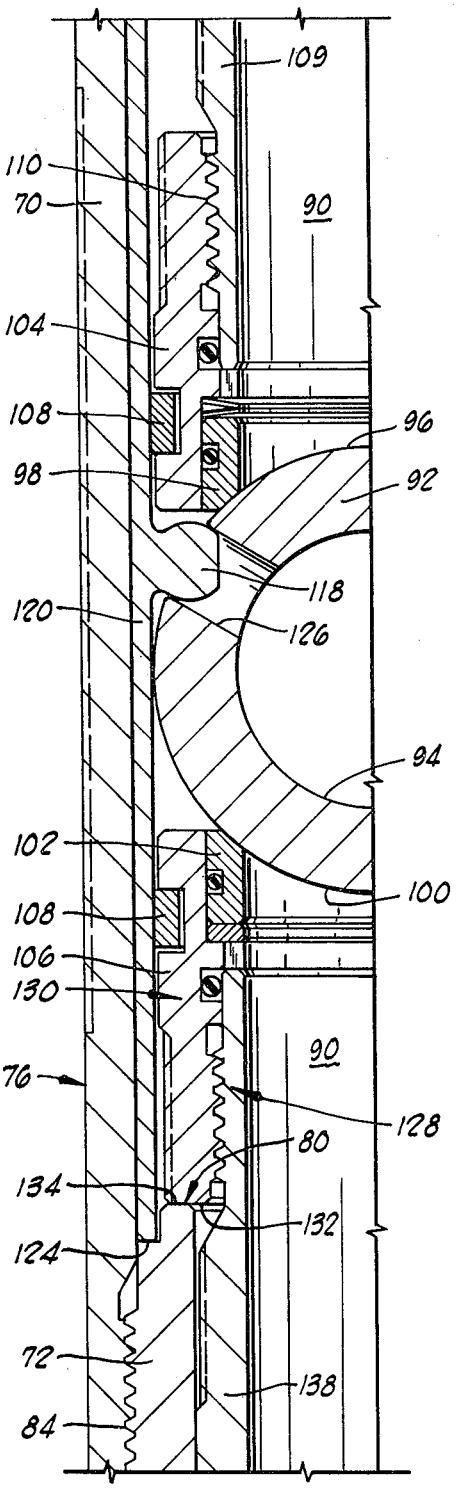

Disposed within flow passage 90 is a spherical valve member 92 which has a valve bore 94 therethrough. Spherical valve member 92 is shown in FIG. 2B in its closed position closing the flow passage 90.

The spherical valve member 92 has its upper surface 96 seated against an upper valve seat 98 and has its lower surface 100 seated against a lower valve seat 102.

The upper valve seat 98 is disposed in an upper valve seat carrier 104 and the lower valve seat 102 is disposed in a lower valve seat carrier 106. The upper and lower valve seat carriers 104 and 106 are connected together by a plurality of C-clamps, such as the clamp 108, two ends of which are shown in FIG. 2B. It will be understood that the C-clamp 108 is a continuous member between the two ends which are illustrated in FIG. 2B, and it therefore holds the valve seat carriers 104 and 106 together about spherical valve member 92.

A positioning mandrel or guide mandrel 109 has its lower end attached to upper valve seat carrier 104 at threaded connection 110 and has an upper end 112 closely received within a cylindrical inner surface 114 of upper adapter 68. An annular seal 116 is disposed between positioning mandrel 108 and inner cylindrical surface 114.

An eccentric lug 118 is attached to a lug carrying mandrel 120 which is received within valve casing 70 and engaged at its upper and lower ends 122 and 124, respectively, by upper adapter 68 and by upper end 80 of middle adapter 72 so that eccentric lug 118 is held in a fixed position relative to housing 66.

The eccentric lug 118 engages an eccentric hole 126 disposed radially through a wall of spherical valve member 92.

A second eccentric lug (not shown) similar to lug 118 also engages another eccentric hole (not shown) of spherical valve member 92 in a manner similar to that shown in FIGS. 4A–4C of U.S. Pat. No. 3,856,085 to Holden et al., the details of which are incorporated herein by reference.

It will be appreciated that the representation of the eccentric lug 118 and mandrel 120, and of the C-clamp 108 are rather schematically shown in FIG. 2B, for purposes of convenient illustration, and that in a true sectional view of the drill pipe tester valve, both the lug 118 and the C-clamp 108 would not be shown in the same sectional view since the two are radially spaced.

When the spherical valve member 92 is moved axially relative to housing 66, in a manner which will be further described below, the engagement of lug 118 with eccentric hole 126 causes causes the spherical valve member 92 to be rotated relative to housing 66 between open and closed positions wherein flow passage 90 is opened and closed, respectively. The spherical valve member 92 is shown in FIG. 2B in its closed position. By movement of spherical valve member 92 axially upward relative to housing 66 from the position shown in FIG. 2B, the spherical valve member 92 is caused to be rotated toward an open position wherein the valve bore 94 is aligned with the flow passage 90 of housing 66 so as to permit flow of fluid through the flow passage 90 from one end to the other of housing 66.

Moving means generally designated by the numeral 128 are provided for moving spherical valve member 92 axially relative to housing 66. The moving means 128 may be considered as including the lower valve seat carrier 106 and the lower valve seat 102 which may be collectively referred to as a lower valve seat means 130. The lower valve seat means 130 is also sometimes referred to in the following description as a lower valve member seat means.

The lower valve seat carrier 106 includes an annular downward facing surface 132 which is supportably engaged by an upward facing surface 134 of upper end 80 of middle adapter 72 of housing 66 when spherical valve member 92 is in its closed position as illustrated in FIG. 2B. This arrangement permits downward forces exerted upon spherical valve member 92 when in its closed position, due to fluid pressure in the test string 34 above spherical valve member 92, to be transmitted substantially entirely to housing 66 through said engagement of downward facing surface 132 and upward facing surface 134. This provides a very strong support below the spherical valve member 92 so that when the very high fluid pressures from testing of drill pipe are exerted upon the upper surface 96 of spherical valve member 92, those pressures will be transmitted directly to the housing 66 rather than being transmitted to lugs 118 and creating problems of failure of those lugs as was described above with regard to use of prior art devices such as that of Holden, et al. U.S. Pat. No. 3,856,085.

In the disclosed embodiment the downward facing surface 132 is specifically located upon the lower valve seat carrier 106. It may, however, be generally said to be located upon the lower valve seat means 130, and it will be understood that the physical arrangement of the lower valve seat means 130 could be modified to include additional elements or to integrate seat 102 and seat carrier 106 into a single element. All that is important is that a downward facing surface, such as surface 132, be located upon a structure which structurally supports the spherical valve member 92 from below. Such structure may generally be referred to as a lower valve seat means.

The moving means 128 also includes a moving mandrel means 136 which is comprised of an upper moving mandrel portion 138 and a lower moving mandrel portion 140.

The upper moving mandrel portion 138 and an upper part of the lower moving mandrel portion 140 are reciprocably received within the lower end of housing 66 and are each reciprocable between respective upper and lower positions relative to housing 66. The upper moving mandrel portion 138 is attached to lower valve seat carrier 106 and may be said to be operably associated with lower valve seat carrier 106 so that upper and lower positions of the upper moving mandrel portion 128 correspond to upper and lower positions of the lower valve seat holder 106 relative to housing 66.

The lower position of lower valve seat holder 106 as illustrated in FIG. 2B corresponds to the closed position of spherical valve member 92 as illustrated. Upon upward movement of lower valve seat holder 106 relative to housing 66, the spherical valve member 92 is moved axially upward relative to housing 66 and is rotated to its open position as previously described by the engagement of eccentric hole 126 with eccentric lug 118.

The lower valve mandrel portion 140 includes a first uppermost section 142, a second section 144 connected to the lower end of first section 142, a third section 146 connected to the lower end of section 144, and a lower adapter 148 connected to the lower end of third section 146. Lower adapter 148 includes an externally threaded lower end 150 for connection to those components of test string 34 located below drill pipe tester valve 62.

Extending radially outward from an outer surface of third section 146 of lower moving mandrel portion 140 of moving mandrel means 136 is a positioning lug 152.

Disposed within a radially inner surface of second valve casing portion 74 of housing 66 is a positioning slot means 154 in which positioning lug 152 is received. A laid-out view of positioning slot means 154 and positioning lug 152 is shown in FIG. 3 which is a view taken generally along line 3—3 of FIGS. 2C and 2D. The positioning slot means 154 and positioning lug 152 are so arranged and constructed that when test string 34 is rotated clockwise and a weight of testing string 34 is set down upon housing 66, the lower moving mandrel portion 140 and with it the upper moving mandrel portion 138 are moved to their upper positions relative to housing 66 thereby opening spherical valve member 92.

The position of lug 152 relative to slot 154 as the test string 34 is lowered into the well is shown in solid lines in FIG. 3. The position after test string 34 is set down is shown in phantom lines.

It will be understood by those skilled in the art that when the weight of test string 34 is set down upon housing 66, the lower moving mandrel portion 140 will not move axially relative to casing 16 of the well (see FIG. 1), because of engagement of the packer means 46 (see FIG. 1) with the casing 16.

The packer means 46 is preferably a "Halliburton RTTS" retrievable packer such as is shown and described in Halliburton Services Sales and Service Catalog No. 40 at Page 3490. The design of such packers is well known to those skilled in the art and generally includes a drag block means for engaging the casing of the well so as to provide an initial friction between the packer and the well. When the weight of the drill string is set down upon the packer means 46, the drag block means allows a set of slips to be set against the casing and then the same continuous downward motion serves to compress and expand a packer element to seal the annulus 40 between the test string 34 and the well casing 16. The actuating components of the packer means 46 include a packer slot means (not shown) and a packer lug means (not shown) constructed similar to the lug means 152 and the slot means 154 shown in FIG. 3, i.e., the slot and lug means of the packer 46 are constructed the same as the slot and lug means of the drill pipe tester valve 62, so that the same setting down motion of the test string 34 which opens the spherical valve member 92 also sets the packer means 46.

When the well testing string 34 is picked up, the housing 66 is moved upward relative to the well casing 16 and accordingly the moving mandrel means 136 is moved downward relative to housing 66 to its said lower position thereby once again closing spherical valve member 92.

Lower moving mandrel portion 140 includes an upper end 156 adapted for engagement with a lower end 158 of upper moving mandrel portion 138, so that when the weight of the test string 34 is set down upon housing 66, the lower moving mandrel portion 140 is moved upward relative to housing 66 and is engaged with upper moving mandrel portion 138 to move the upper moving mandrel portion 138 upward relative to housing 66, thereby opening spherical valve member 92.

The moving mandrel means 136 includes a latch means generally indicated by the numeral 160 for latching spherical valve member 92 in its said closed position as the test string 34 is lowered into the well.

Latch means 160 includes a plurality of resilient spring collet fingers such as fingers 162, 164 and 166, extending downward from upper moving mandrel portion 138. Each of said spring collet fingers includes a head 168 and its lower end with radially inner and outer upward facing shoulders 170 and 172, respectively, defined upon the head 168. Shoulders 170 and 172 are tapered.

Latch means 160 further includes an annular radially inner recess means 174 in an inner surface of housing 66. An upper end of said recess means is defined by a downward facing annular shoulder 176 of housing 66. Recess means 174 provides a means for receiving the radially outer upward facing shoulders 172 of the spring collet fingers when the spherical valve member 92 is in its said closed position. Latch means 160 further includes a radially outer cylindrical surface means 178 on first section 142 of lower moving mandrel portion 140 for engaging a radially inner surface 180 of the heads 168 of the spring collet fingers, and holding the heads 168 within the recess means 174 of housing 66 when the spherical valve member 92 is in its closed position.

Additionally, lower moving mandrel portion 140 includes a radially outer annular recess means 182 located below radially outer cylindrical surface 178, for receiving the radially inner upward facing shoulders 170 of heads 168 of the spring collet fingers, such as finger 166, when the upper end 156 of lower moving mandrel portion 140 is in engagement with lower end 158 of upper moving mandrel portion 138.

The purpose of latch means 160 is best understood by describing the functions it accomplishes in sequence as the well test string 34 is lowered into the well, then as the well test string 34 is set down upon the housing 66, and then as the well test string 34 is subsequently picked up.

Figure 2C:
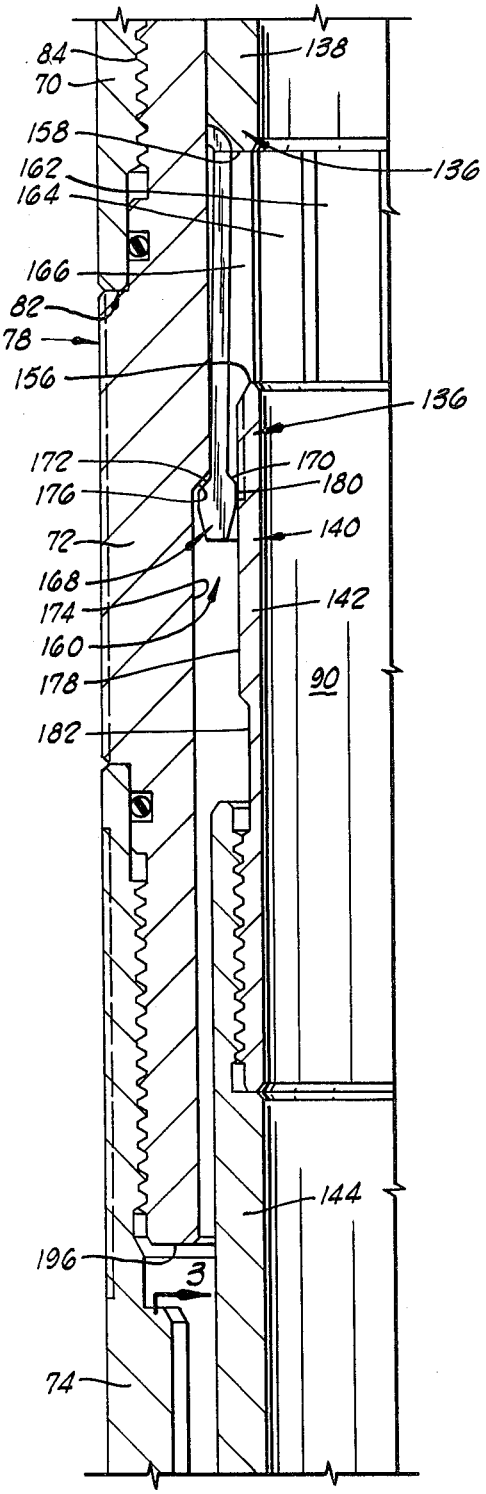
Figure 2D:
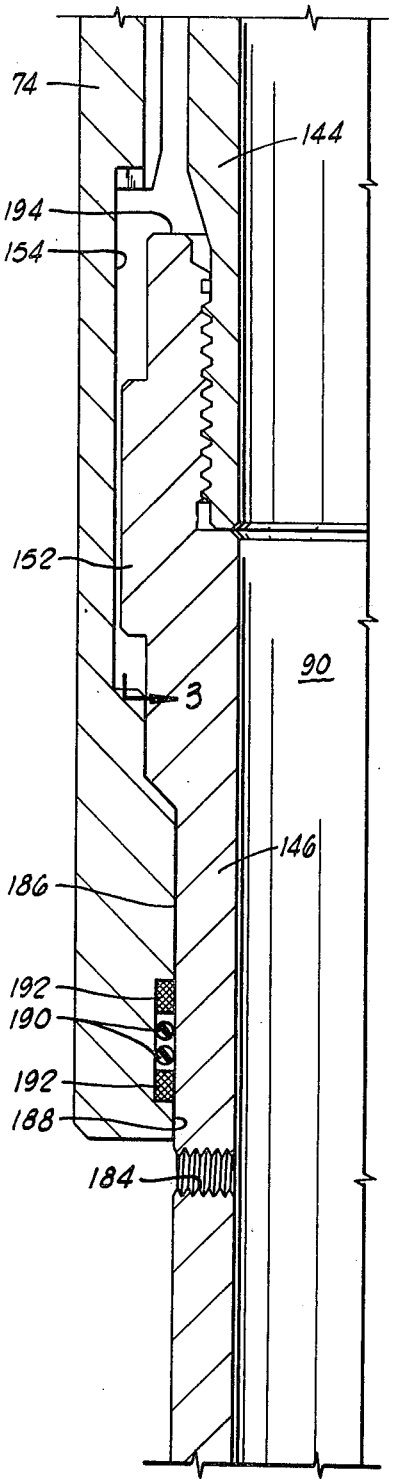
Figure 2E:
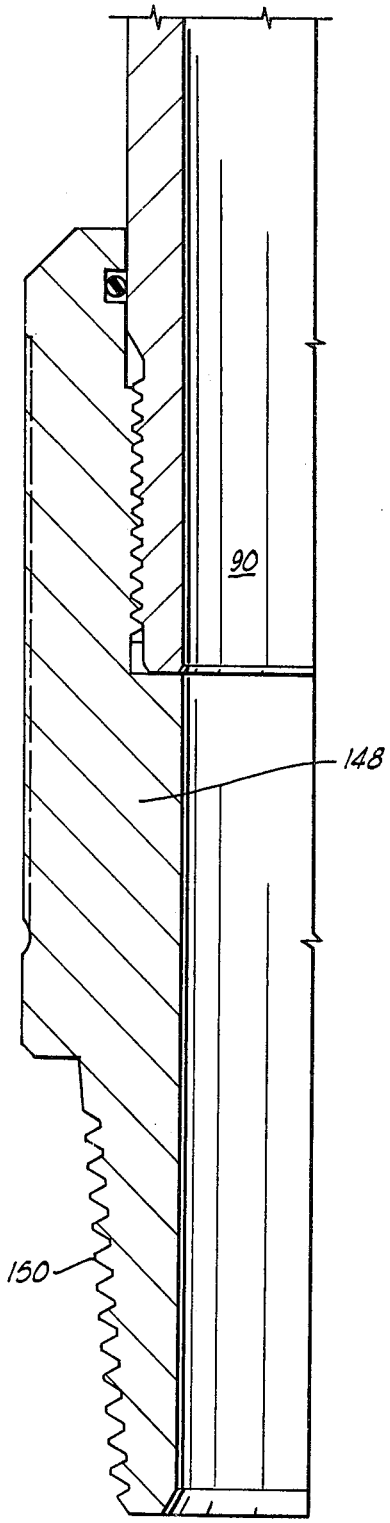
Figure 3:
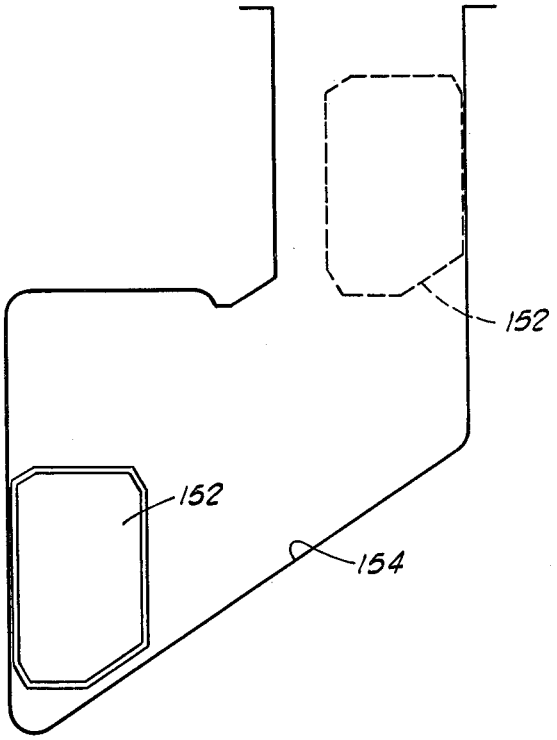
FIG. 3 shows a laid-out view of a J-slot and lug of the drill pipe tester valve of FIGS. 2A–2E.

When the well test string 34 is run into the well, the components of the drill pipe tester valve 62, and particularly the latch means 160, are in the relative positions illustrated in FIGS. 2A–2E. As is seen in FIG. 2C, the latch means 160 at this point provides a means for releasably locking upper moving mandrel portion 138 relative to housing 66 in a position holding spherical valve member 92 in its said closed position as the well test string 134 is lowered into a well. This upper moving mandrel portion 138 is locked in the described position due to engagement of outer shoulder 178 of the heads 168 of the collet fingers with the recess 174 of the housing 66, and due to the presence of the radially outward surface 178 of lower moving mandrel portion 140 which holds the heads 168 in the described position.

When the well test string 34 is located in its desired final position within the well, the weight of the test string is set down upon the housing 66 as previously described. During that operation the latch means 160 provides a means for releasing upper moving mandrel portion 138 relative to housing 66. This releasing function is accomplished by upward movement of lower moving mandrel portion 140 relative to upper moving mandrel portion 138 prior to engagement of the upper end 156 of lower moving mandrel 140 with the lower end of upper moving mandrel portion 138. When the inner shoulders 170 of the heads 168 of the collet fingers become located opposite the radially outer recess 182 of lower moving mandrel portion 140, the heads 168 of the collet fingers are moved radially inward into the recess 182 thereby releasing upper moving mandrel portion 138 from its previously latched engagement with housing 66.

Additionally, as the weight of test string 34 continues to be set down upon housing 66, the latch means 160 provides a means for releasably locking lower moving mandrel portion 140 to upper moving mandrel portion 138. This is accomplished by the receiving of the inner shoulder 170 of heads 168 within recess 182 of lower moving mandrel portion 140 and the subsequent upward movement of both upper and lower moving mandrel portions 138 and 140 relative to housing 66 after the upper end 156 of lower moving mandrel portion 140 engages the lower end 158 of upper moving mandrel portion 138. Additional upward movement of the upper and lower moving mandrel portions relative to housing 66 provides the axial upward movement of valve member 92 necessary to move the same to its open position as previously described.

When the well testing procedures are completed or whenever for some reason the test string 34 is picked up from the well, the latch means 160, due to the fact that it has latched the upper and lower moving mandrel portions 138 and 140 together, provides a means for moving the upper moving mandrel portion 138 downward relative to housing 66 when the well test string is picked up. This is because the lower moving mandrel portion 140 is fixed relative to the casing 16 of the well because of engagement of the packer means 46 with the casing 16. Therefore, since the upper and lower moving mandrel portions are for a time latched together by latch means 160, this causes the upper moving mandrel portion 138 to also be held in position relative to well casing 16 when the well test string 34 is initially picked up.

Subsequently, during the pick up operation, after the upper moving mandrel portion 138 has moved downward relative to housing 66 sufficiently so that lower annular surface 132 of lower valve seat carrier 106 engages upper surface 134 of housing 66, and radially outer shoulder 172 of heads 168 of the collet spring fingers are once again received in the inner recess 174 of housing 66, the lower moving mandrel portion 140 is released from its latched attachment to the upper moving mandrel portion 138 and the components of the drill pipe tester valve 62 are once again in the relative positions illustrated in FIGS. 2A–2E.

The third section 146 of lower moving mandrel portion 140 includes an equalization port means 184 disposed through a wall thereof for communicating the flow passage 90 of housing 66 below spherical valve member 92 with the annulus 40 between the test string 34 and the well casing 16 when spherical valve member 92 is in its closed position. The annulus 40 may be generally described as a zone outside of housing 66.

Third section 146 of lower moving mandrel portion 140 further includes an outer cylindrical surface 186 closely received within an inner cylindrical surface 188 of a lower end of second valve casing portion 74 of housing 66.

An annular sealing means 190 is disposed between outer cylindrical surface 186 and inner cylindrical surface 188. Non-metallic backup rings 192 are provided on either side of the annular seals 190. The housing 66, lower moving mandrel portion 140, and annular seal means 190 are so arranged and constructed that when the weight of the test string 34 is set down upon housing 66, and the lower moving mandrel portion 140 is moved upward relative to housing 66, the equalization portion 184 is closed before the spherical valve member 92 is open.

Equalization port 184 also equalizes the pressure across the walls of moving mandrel 136 to prevent inward collapse thereof due to the hydrostatic head in annulus 40. It also prevents a hydraulic pressure lock from occurring between spherical valve member 92 and the formation tester valve 60 when the moving mandrel means 136 is telescoped into housing 66.

Upward movement of lower moving mandrel portion 140 relative to housing 66 is limited by engagement of an upward facing shoulder 194 of lower moving mandrel portion 140 with a downward facing shoulder 196 of housing 66, which combination of shoulders 194 and 196 may generally be described as a stop means for limiting upward movement of lower moving mandrel portion 140 relative to housing 66.

The methods of utilizing the drill pipe tester valve of the present invention are generally as follows.

The purpose of the drill pipe tester valve is to allow the drill pipe to be pressure tested periodically as it is lowered into the well to determine whether there are any leaks between successive joints of drill pipe.

The drill pipe tester valve of the present invention is generally run directly above a formation tester valve 60 such as the formation tester of Holden, et al., disclosed in U.S. Pat. No. 3,856,085. The use of the drill pipe tester valve of the present invention provides a method for testing the drill pipe without exerting the test pressures upon the spherical valve member of the formation tester valve 60 (see FIG. 1) with the problems accompanied therewith as previously described, and also provides a safety feature.

The drill pipe tester valve 62 is attached to a lower end of a string of pipe, and below the drill pipe tester valve 62 is connected the formation tester valve 60 and a packer means 46 generally as shown in FIG. 1.

The string of pipe or the well test string 34 is then lowered into the well. The string of pipe above the spherical valve member 92 is filled with fluid by filling from the work deck 26.

Periodically, during the lowering operation, the lowering is stopped and the string of pipe is located statically within the well. Then the string of pipe is pressure tested while the string of pipe is stopped and while the spherical valve member is in its closed position. This stopping is done periodically so that successive portions of the string of pipe are pressure tested periodically as the string of pipe is lowered into the well.

During the pressure testing operation, the lower valve seat holder 106 is supported against downward force exerted upon spherical valve member 92 by pressure testing of the pipe, from the housing 66 by engagement of the downward facing surface 132 of lower valve seat holder 106 with the upward facing annular surface 134 of housing 66.

The upper moving mandrel portion 140 is locked relative to the housing 66 by latch means 160 thereby holding the spherical valve member 92 in the closed position while the string of pipe is being lowered into the well. When the string of pipe is finally positioned within the well and the weight of the string of pipe is set down upon the housing 66, the upper moving mandrel portion of the drill pipe tester valve 62 is released relative to the housing 66 and the lower moving mandrel portion is locked to the upper moving mandrel portion. The spherical valve member 92 is moved upward relative to the housing 66 and rotated to an open position so that it does not interfere with the formation testing operation or with the lowering of wire line tools through the test string.

Then upon picking up the string of pipe after the testing procedure is completed, or whenever it is necessary to pick up the string of pipe for some other reason, the upper moving mandrel portion is moved downward relative to the housing 66, thereby closing the spherical valve member 92, and the upper moving mandrel portion is released from its latched attachment to the lower moving mandrel portion 140.

Also, the packer means 46 is provided below the drill pipe tester valve for sealing the annulus 40 between the test string 34 and the well casing 16, and the packer means 46 utilizes a J-slot and lugs similar to that of the drill pipe tester valve as shown in FIG. 3, so that when the weight of the test string 34 is set down upon the housing 66 to open the valve member 92, that same setting down motion also sets the packer means against the well casing.

Thus, it is seen that the Drill Pipe Tester and Safety Valve of the present invention readily achieves the ends and advantages mentioned as well as those inherent therein. While presently preferred embodiments of the invention have been illustrated for the purposes of this disclosure, numerous changes in the arrangement and construction of parts may be made by those skilled in the art, which changes are encompassed by the scope and spirit of this invention as defined by the appended claims.

What is claimed is:

1. A pipe tester valve, comprising:

a housing having a first end adapted to be connected to a string of pipe, and having a flow passage therethrough;

a spherical valve member disposed in said flow passage of said housing;

lug means, attached to said housing, for engaging said spherical valve member and rotating said spherical valve member between open and closed positions wherein said flow passage is open and closed, respectively, as said spherical valve member is moved axially relative to said housing and said lug means; and moving means for moving said spherical valve member axially relative to said housing between its said open and closed positions, said moving means including:

a lower valve member seat means having a downward facing surface supportably engaged by an upward facing surface of said housing when said spherical valve member is in its said closed position, so that downward forces exerted on said spherical valve member in its said closed position due to fluid pressure in said string of pipe above said spherical valve member are transmitted to said housing through said engagement of said downward facing surface and said upward facing surface; and latch means for latching said spherical valve member in its said closed position as said string of pipe and pipe tester valve are lowered into a well.

2. The pipe tester valve of claim 1, wherein:

said moving means further includes an upper moving mandrel portion attached to said lower valve member seat means and a lower moving mandrel portion having an upper end adapted for engagement with a lower end of said upper moving mandrel portion, so that when a weight of said string of pipe is set down on said housing said lower moving mandrel portion is moved upward relative to said housing and is engaged with said upper moving mandrel portion to move said upper moving mandrel portion upward relative to said housing thereby opening said spherical valve member; and said latch means includes first locking means for releasably locking said upper moving mandrel portion relative to said housing in a position holding said spherical valve member in its said closed position as said string of pipe and pipe tester valve are lowered into a well prior to said setting down of the weight of said string of pipe on said housing.

3. The pipe tester valve of claim 2, wherein:

said latch means is further characterized as including first releasing means for releasing said upper moving mandrel portion relative to said housing when said weight of said string of pipe is set down on said housing.

4. The pipe tester valve of claim 3, wherein:

said latch means is further characterized as including a second locking means for releasably locking said lower moving mandrel portion to said upper moving mandrel portion when said weight of said string of pipe is set down on said housing, and for moving said upper moving mandrel portion downward relative to said housing when said string of pipe is picked up after being set down, so that said spherical valve member is closed when said string of pipe is picked up.

5. The pipe tester valve of claim 4, wherein:

said latch means is further characterized as including a second releasing means for releasing said upper moving mandrel portion from said lower moving mandrel portion after said spherical valve member is closed when said string of pipe is picked up.

6. The pipe tester valve of claim 5, wherein said first and second locking means and said first and second releasing means of said latch means are all comprised of:

a plurality of resilient spring collet fingers extending downward from said upper moving mandrel portion, each of said spring collet fingers including a head on a lower end thereof with radially inner and outer upward facing shoulders defined upon said head;

an annular radially inner recess means in said housing, an upper end of which recess means is defined by a downward facing annular shoulder, for receiving said radially outer upward facing shoulders of said spring collet fingers when said spherical valve member is in its said closed position;

a radially outer cylindrical surface means, on said lower moving mandrel portion, for engaging a radially inner surface of said heads of said spring collet fingers and holding said heads within said recess means of said housing when said spherical valve member is in its said closed position; and a radially outer annular recess means, disposed in said lower moving mandrel portion below said radially outer cylindrical surface means of said lower moving mandrel portion, for receiving said radially inner upward facing shoulders of said heads of said spring collet fingers when said upper end of said lower moving mandrel portion is in engagement with said lower end of said upper moving mandrel portion.

7. The pipe tester valve of claim 2, wherein:

one of said lower moving mandrel portion and said housing includes a positioning lug; and the other of said lower moving mandrel portion and said housing includes a positioning slot means in which said positioning lug is received, said positioning slot means and positioning lug being so arranged and constructed that when said weight of said pipe string is set down on said housing said lower moving mandrel portion is moved upward relative to said housing thereby opening said spherical valve member, and when said pipe string is picked up said lower moving mandrel portion is moved to a lower position relative to said housing thereby closing said spherical valve member.

8. The pipe tester valve of claim 7, wherein:

said lower moving mandrel portion includes an equalization port means, disposed through a wall thereof, for communicating said flow passage of said housing below said spherical valve member with a zone outside of said housing when said spherical valve member is in its said closed position.

9. The pipe tester valve of claim 8, wherein:

said lower moving mandrel portion includes an outer cylindrical surface closely received within an inner cylindrical surface of said lower end of said housing; and said pipe tester valve further comprises annular sealing means disposed between said outer cylindrical surface of said lower moving mandrel portion and said inner cylindrical surface of said housing, said housing, moving mandrel means and annular sealing means being so arranged and constructed that when said weight of said string of pipe is set down on said housing and said lower moving mandrel portion is moved upward relative to said housing said equalization port means is closed before said spherical valve member is opened.

10. The pipe tester valve of claim 2, further comprising:

stop means for limiting upward movement of said lower moving mandrel portion relative to said housing.

11. A well test string including the pipe tester valve of claim 2, and further comprising:

a formation tester valve connected to a lower end of said pipe tester valve so that said string of pipe above said pipe tester valve may have said fluid pressure exerted thereupon to pressure test said string of pipe without said fluid pressure being exerted upon said formation tester valve.

12. The well test string of claim 11, wherein:

said lower moving mandrel portion of said pipe tester valve includes an equalization port means, disposed through a wall thereof, for communicating said flow passage of said housing below said spherical valve member with an annulus between said test string and a well casing when said spherical valve member is in its said closed position.

13. The well test string of claim 12, wherein:

one of said lower moving mandrel portion and said housing includes a positioning lug; and the other of said lower moving mandrel portion and said housing includes a positioning slot means in which said positioning lug is received, said positioning slot means and positioning lug being so arranged and constructed that when said well test string is set down said lower moving mandrel portion is moved to an upper position relative to said housing thereby opening said spherical valve member, and when said well test string is picked up said lower moving mandrel portion is moved to a lower position relative to said housing thereby closing said spherical valve member.

14. The well test string of claim 13, further comprising:

packer means, connected to said formation test valve, for sealing said annulus between said well test string and said well casing above a formation of said well which is to be tested, said packer means including a packer slot means and a packer lug means cooperating with said packer slot means, said packer slot and lug means being arranged and constructed similar to said positioning slot means and positioning lug means of said pipe tester valve so that the same setting down motion of said well test string which opens said spherical valve member of said pipe tester valve also sets said packer means.

15. The pipe tester valve of claim 1, wherein:

said housing includes an upper housing portion and a lower housing portion, an upper end of said lower housing portion being received within and attached to a lower end of said upper housing portion.

16. The pipe tester valve of claim 15, wherein:

said lug means includes a lug carrying mandrel received within said upper housing portion and retained in place therein by engagement with said upper end of said lower housing portion.

17. The pipe tester valve of claim 16, wherein:

said upward facing surface of said housing is defined upon said upper end of said lower housing portion.

18. The pipe tester valve of claim 15, wherein:

said upward facing surface of said housing is defined upon said upper end of said lower housing portion.

19. The pipe tester valve of claim 1, wherein:

said lower valve member seat means of said moving means is movable between an upper and a lower position, relative to said housing, said upper and lower positions of said lower valve member seat corresponding to said open and closed positions of said spherical valve member, respectively.

20. A method of pressure testing a string of pipe as said string of pipe is lowered into a well, said method comprising the steps of:

providing on a lower end of said string of pipe a pipe tester valve including a housing having a flow passage therethrough, a spherical valve member disposed in said flow passage of said housing, lower valve seat means sealingly engaging a lower surface of said spherical valve member and having a downward facing surface supportably engaged by an upward facing surface of said housing when said spherical valve member is in a closed position, an upper moving mandrel portion attached to said lower valve seat means, and a lower moving mandrel portion having an upper end adapted for engagement with a lower end of said upper moving mandrel portion;

lowering said string of pipe into said well;

locking said upper moving mandrel portion relative to said housing and holding said spherical valve member in a closed position while said string of pipe is being lowered into said well;

filling said string of pipe above said spherical valve member with a fluid;

stopping said lowering of said string of pipe periodically;

pressure testing said string of pipe while said lowering of said string of pipe is stopped and said spherical valve member is in its said closed position so that successive portions of said string of pipe are pressure tested periodically as said string of pipe is lowered into said well, and supporting said lower valve seat means, against a downward force exerted on said spherical valve member by said pressure testing of said string of pipe, from said housing by said engagement of said downward facing surface of said lower valve seat means and said upward facing surface of said housing.

21. The method of claim 20, further comprising the step of:

setting down a weight of said string of pipe on said housing when said string of pipe is finally positioned within said well and thereby moving said spherical valve member upward relative to said housing and rotating said spherical valve member to an open position.

22. The method of claim 21, further comprising the step of:

releasing said upper moving mandrel portion relative to said housing when said weight of said string of pipe is set down on said housing.

23. The method of claim 22, further comprising the step of:

locking said lower moving mandrel portion to said upper moving mandrel portion when said weight of said string of pipe is set down on said housing.

24. The method of claim 23, further comprising the steps of:

picking up said string of pipe;

moving said upper moving mandrel portion downward relative to said housing when said string of pipe is picked up; and thereby closing said spherical valve member when said string of pipe is picked up.

25. The method of claim 24, further comprising the step of:

releasing said upper moving mandrel portion from said lower moving mandrel portion after said spherical valve member is closed when said string of pipe is picked up.

* * * * *

UNITED STATES PATENT AND TRADEMARK OFFICE

CERTIFICATE OF CORRECTION

PATENT NO. : 4,319,633

DATED : March 16, 1982

INVENTOR(S) : Michael E. McMahan et al.

It is certified that error appears in the above—identified patent and that said Letters Patent is hereby corrected as shown below:

Column 4, line 46, delete "to".

Column 8, line 61, after "168" and before "its", delete "and" and insert -- at --.

Signed and Sealed this

*Sixth* Day of *July 1982*

[SEAL]

*Attest:*

GERALD J. MOSSINGHOFF

*Attesting Officer*

*Commissioner of Patents and Trademarks*